US008505918B1

(12) United States Patent
Appelblatt

(10) Patent No.: US 8,505,918 B1
(45) Date of Patent: Aug. 13, 2013

(54) THREE DIMENSIONAL TIC-TAC-TOE GAME

(71) Applicant: Robert Appelblatt, Jericho, NY (US)

(72) Inventor: Robert Appelblatt, Jericho, NY (US)

(73) Assignee: Accomplice Productions, LLC, New York, NY (US)

( * ) Notice: Subject to any disclaimer, the term of this patent is extended or adjusted under 35 U.S.C. 154(b) by 0 days.

(21) Appl. No.: 13/760,724

(22) Filed: Feb. 6, 2013

Related U.S. Application Data

(60) Provisional application No. 61/678,203, filed on Aug. 1, 2012.

(51) Int. Cl.
*A63F 3/00* (2006.01)

(52) U.S. Cl.
USPC ..... 273/271; 273/239; 273/241

(58) Field of Classification Search
USPC ..... 273/239, 241, 242, 271, 284, 288, 273/290, 282.1
See application file for complete search history.

(56) References Cited

U.S. PATENT DOCUMENTS

| | | | | | |
|---|---|---|---|---|---|
| 2,485,143 | A | * | 10/1949 | Duncan | 273/290 |
| D172,796 | S | * | 8/1954 | Kaye | D21/336 |
| 2,801,107 | A | | 7/1957 | Greer, Jr. | |
| 3,464,701 | A | | 9/1969 | Mahoney | |
| D217,975 | S | | 7/1970 | Pruett | |
| 3,680,865 | A | * | 8/1972 | Davis | 273/239 |
| 3,695,614 | A | * | 10/1972 | Brisson | 273/241 |
| 3,751,039 | A | * | 8/1973 | Dykoski | 273/260 |
| 3,822,487 | A | * | 7/1974 | Koch | 434/172 |
| 3,879,040 | A | | 4/1975 | Smith | |
| 3,884,474 | A | | 5/1975 | Harper | |
| 3,888,487 | A | | 6/1975 | Replogle | |
| 3,993,313 | A | * | 11/1976 | Tillotson | 273/282.1 |
| 4,371,169 | A | | 2/1983 | Compton | |
| 4,462,596 | A | * | 7/1984 | Yamamoto | 273/239 |
| D296,798 | S | | 7/1988 | Smith | |
| 5,069,458 | A | * | 12/1991 | Washington | 273/238 |
| 5,085,440 | A | | 2/1992 | Van Dam | |
| 5,433,448 | A | | 7/1995 | Raphael et al. | |
| 5,655,773 | A | | 8/1997 | Marks | |
| 6,254,098 | B1 | | 7/2001 | Kirkpatrick | |
| D507,307 | S | | 7/2005 | Austin | |
| D513,043 | S | | 12/2005 | Hunley | |
| D538,354 | S | | 3/2007 | Harman | |
| 8,292,298 | B2 | * | 10/2012 | Strum | 273/285 |

OTHER PUBLICATIONS

Brilliant Puzzles, "TIC-TAC-TOE 3D-Strategy Wooden Game"; http://stores.brilliantpuzzles.com/-strse-221/3D-TicTacToe-Game/Detail.bok, printed Mar. 26, 2012 (2 pages).

* cited by examiner

*Primary Examiner* — Vishu K. Mendiratta
(74) *Attorney, Agent, or Firm* — Greenberg Traurig, LLP

(57) ABSTRACT

A three-dimensional tic-tac-toe game including a game board having a plurality of modules adapted to be interconnected to one another, a plurality of X-shaped game pieces, and a plurality of O-shaped pieces. Each of the X-shaped game pieces and O-shaped pieces includes protrusions at one end and recesses in an opposite end. Each of the modules includes recesses. The protrusions of each of the X-shaped and O-shaped pieces are adapted to engage the recesses of the modules, as well as the recesses of other X-shaped or O-shaped pieces. The X-shaped and O-shaped pieces may be stacked on top of one another for three-dimensional game play. Alternately, the modules and the X-shaped and O-shaped pieces include magnets to engage one another.

15 Claims, 15 Drawing Sheets

THREE DIMENSIONAL TIC-TAC-TOE GAME

CROSS-REFERENCE TO RELATED APPLICATION

This application is a Section 111(a) application relating to and claiming the benefit of commonly owned, U.S. Provisional Patent Application Ser. No. 61/678,203, filed Aug. 1, 2012, the disclosure of which is incorporated herein by reference in its entirety.

FIELD OF THE INVENTION

The present invention relates to a three-dimensional tic-tac-toe game in which X-shaped and O-shaped pieces may be played in three dimensions on a game board, and, more particularly, to a three dimensional tic-tac-toe game in which the players may position their X-shaped and O-shaped pieces, respectively, in a winning construct by placing his or her pieces in a row on or above the game board.

BACKGROUND OF THE INVENTION

There exists three dimensional tic-tic-toe games having game pieces designated as "X-pieces" and "O-pieces". What is needed is a three dimensional tic-tac-toe game that enables game piece configurations to be easily visualized during all stages of game play, includes game pieces that are stackable in a secured fashion, and includes an expandable game board that can provide an infinite array for placing the game pieces.

SUMMARY OF THE INVENTION

In an embodiment, a tic-tac-toe game including a game board having a plurality of modules adapted to be interconnected to one another, each of the plurality of modules including at least one recess; a plurality of first game pieces, each of which includes a first end and a second end opposite the first end, at least one protrusion extending from the first end, and at least one recess formed within the second end; and a plurality of second game pieces, each of which includes a first end and a second end opposite the first end of the second game piece, at least one protrusion extending from the first end of the second game piece, and at least one recess formed within the second end of the second game piece, wherein the at least one protrusion of each of the plurality of first game pieces is sized and shaped to engage the at least one recess of one of the plurality of modules of the game board, the at least one recess of another of the plurality of first game pieces, and the at least one recess of one of the plurality of second game pieces, wherein the at least one protrusion of each of the plurality of second game pieces is sized and shaped to engage the at least one recess of one of the plurality of modules of the game board, the at least one recess of another of the plurality of second game pieces, and the at least one recess of one of the plurality of first game pieces.

In an embodiment, each of the plurality of first game pieces is an X-shaped piece, and each of the plurality of second game pieces is an O-shaped piece. In an embodiment, each of the X-shaped pieces includes a pair of legs, each of which extends from the first end of the X-shaped piece to the second end of the X-shaped piece, wherein the at least one protrusion of the X-shaped piece includes a pair of protrusions, one of which extends from the first end of one of the pair of legs, and the other of which extends from the first end of the other of the pair of legs, wherein the at least one recess of the X-shaped piece includes a pair of recesses, one of which is formed within the second end of one of the pair of legs, and the other of which is formed within the second end of the other of the pair of legs, wherein the at least one protrusion of the O-shaped piece includes a pair of protrusions and the at least one recess of the O-shaped piece includes a pair of recesses, wherein the at least one recess of the plurality of modules of the game board includes a pair of recesses, wherein each of the protrusions of each of the plurality of X-shaped game pieces is sized and shaped to engage a corresponding one of the recesses of one of the plurality of modules of the game board, a corresponding one the recesses of another of the plurality of X-shaped game pieces, and a corresponding one of the recesses of one of the plurality of O-shaped game pieces, wherein each of the protrusions of each of the plurality of O-shaped game pieces is sized and shaped to engage a corresponding one of the recesses of one of the plurality of modules of the game board, a corresponding one the recesses of another of the plurality of O-shaped game pieces, and a corresponding one of the recesses of one of the plurality of X-shaped game pieces.

In an embodiment, each of the plurality of modules of the game board includes at least one tab and at least one groove, wherein the at least one tab of one of the plurality of modules is sized and shaped to engage the at least one groove of another of the plurality of modules. In an embodiment, the at least one tab includes a pair of tabs and the at least one groove includes a pair of grooves. In an embodiment, the plurality of modules form a 3×3 array of the modules. In another embodiment, the modules form a 4×4 array of the modules.

In an embodiment, each of the plurality of first game pieces is adapted to be stacked on top of another of the first game pieces and one of the plurality of second game pieces, and wherein each of the plurality of second game pieces is adapted to be stacked on top of another of the second game pieces and one of the plurality of first game pieces. In an embodiment, each of the plurality of first and second game pieces includes an illumination source.

In an embodiment, a tic-tac-toe game including a game board having a plurality of modules adapted to be interconnected to one another, each of the plurality of modules including at least one magnet; a plurality of first game pieces, each of which includes a first end and a second end opposite the first end, at least one first magnet located at the first end, and at least one second magnet located at the second end; and a plurality of second game pieces, each of which includes a first end and a second end opposite the first end of the second game piece, at least one first magnet located at the first end of the second game piece, and at least one second magnet located at the second end of the second game piece, wherein one of the at least one first and second magnets of each of the plurality of first game pieces is adapted to engage the at least one magnet of one of the plurality of modules of the game board, one of the at least one first and second magnets of another of the plurality of first game pieces, and one of the at least one first and second magnets of one of the plurality of second game pieces, wherein one of the at least one first and second magnets of each of the plurality of second game pieces is adapted to engage the at least one magnet of one of the plurality of modules of the game board, one of the at least one first and second magnets of another of the plurality of second game pieces, and one of the at least one first and second magnets of one of the plurality of first game pieces.

In an embodiment, each of the plurality of first game pieces is an X-shaped piece, and each of the plurality of second game pieces is an O-shaped piece. In an embodiment, each of the X-shaped pieces includes a pair of legs, each of which extends from the first end of the X-shaped piece to the second end of the X-shaped piece, wherein the at least one first magnet of the X-shaped piece includes a pair of first magnets, one of which is located at the first end of one of the pair of legs, and the other of which is located at the first end of the other of the pair of legs, wherein the at least one second magnet of the X-shaped piece includes a pair of second magnets, one of which is located at the second end of one of the pair of legs, and the other of which is located at the second end of the other of the pair of legs, wherein the at least one first magnet of the O-shaped piece includes a pair of first magnets and the at least one second magnet of the O-shaped piece includes a pair of second magnets, wherein the at least one magnet of the plurality of modules of the game board includes a pair of magnets, wherein each of the first magnets of each of the plurality of X-shaped game pieces is adapted to engage a corresponding one of the magnets of one of the plurality of modules of the game board, a corresponding one the second magnets of another of the plurality of X-shaped game pieces, and a corresponding one of the second magnets of one of the plurality of O-shaped game pieces, wherein each of the first magnets of each of the plurality of O-shaped game pieces is adapted to engage a corresponding one of the magnets of one of the plurality of modules of the game board, a corresponding one the second magnets of another of the plurality of O-shaped game pieces, and a corresponding one of the second magnets of one of the plurality of X-shaped game pieces.

In an embodiment, each of the plurality of modules of the game board includes a plurality of magnets located around a periphery thereof, wherein the plurality of magnets of one of the plurality of modules is adapted to engage the plurality of magnets of another of the plurality of modules.

BRIEF DESCRIPTION OF THE DRAWINGS

For a more complete understanding of the present invention, reference is made to the following detailed description of exemplary embodiments considered in conjunction with the accompanying drawings, in which.

DETAILED DESCRIPTION OF THE EXEMPLARY EMBODIMENTS

Although the present invention can be used in conjunction with any type of play pieces, it is particularly suitable for use in connection with X-shaped and O-shaped play pieces for a three-dimensional tic-tac-toe game. Accordingly, the present invention will be described hereinafter in connection with such pieces. It should be understood, however, that the following description is only meant to be illustrative of the present invention and is not meant to limit the scope of the present invention, which has applicability to other types and shapes of game pieces. As will be disclosed herein below, the X-shaped and O-shaped play pieces are positionable on modules of the game board, as well as stackable on each other, to form constructs that are stable, three dimensional and easily visible.

Figure 1:
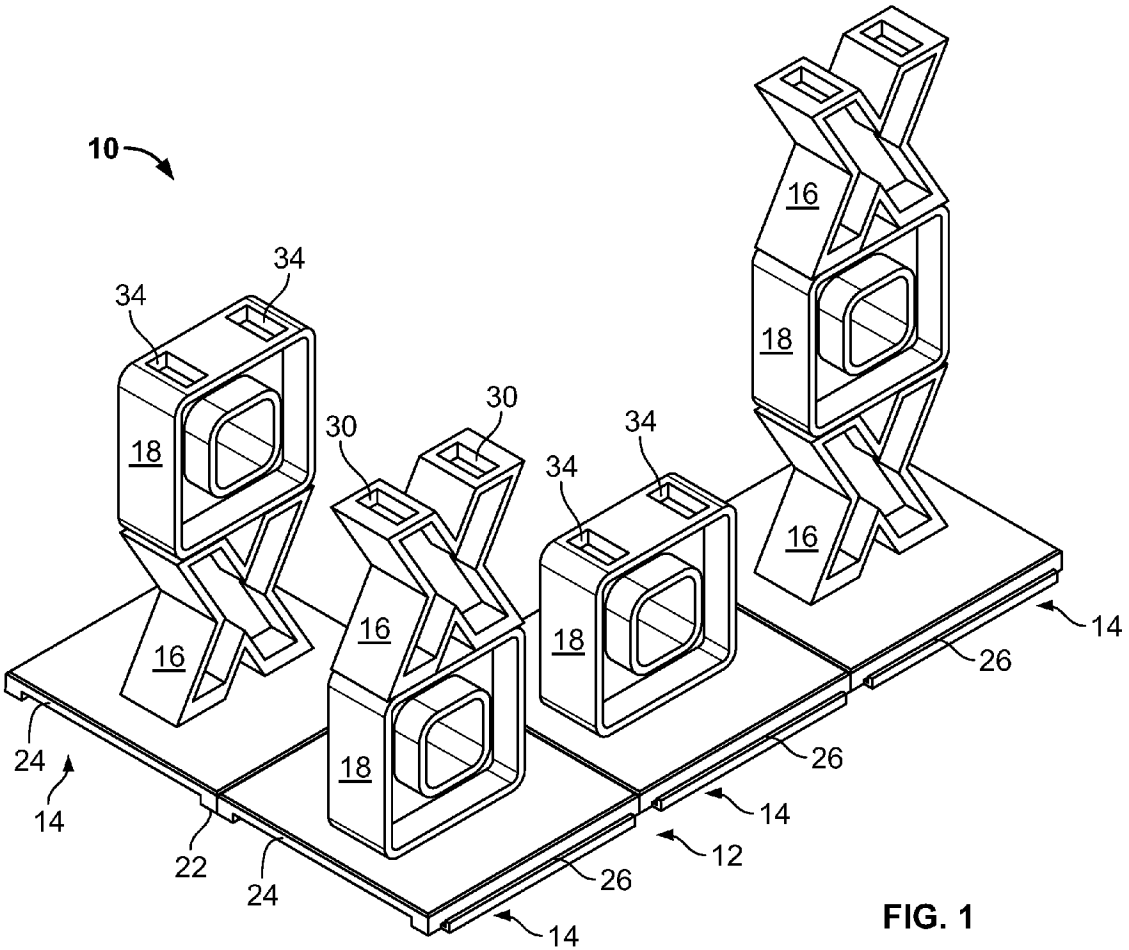
FIG. 1 is a perspective view of a three dimensional tic-tac-toe game constructed in accordance with one embodiment of the present invention, in which X-shaped and O-shaped pieces are arranged on a game board.
Figure 2:
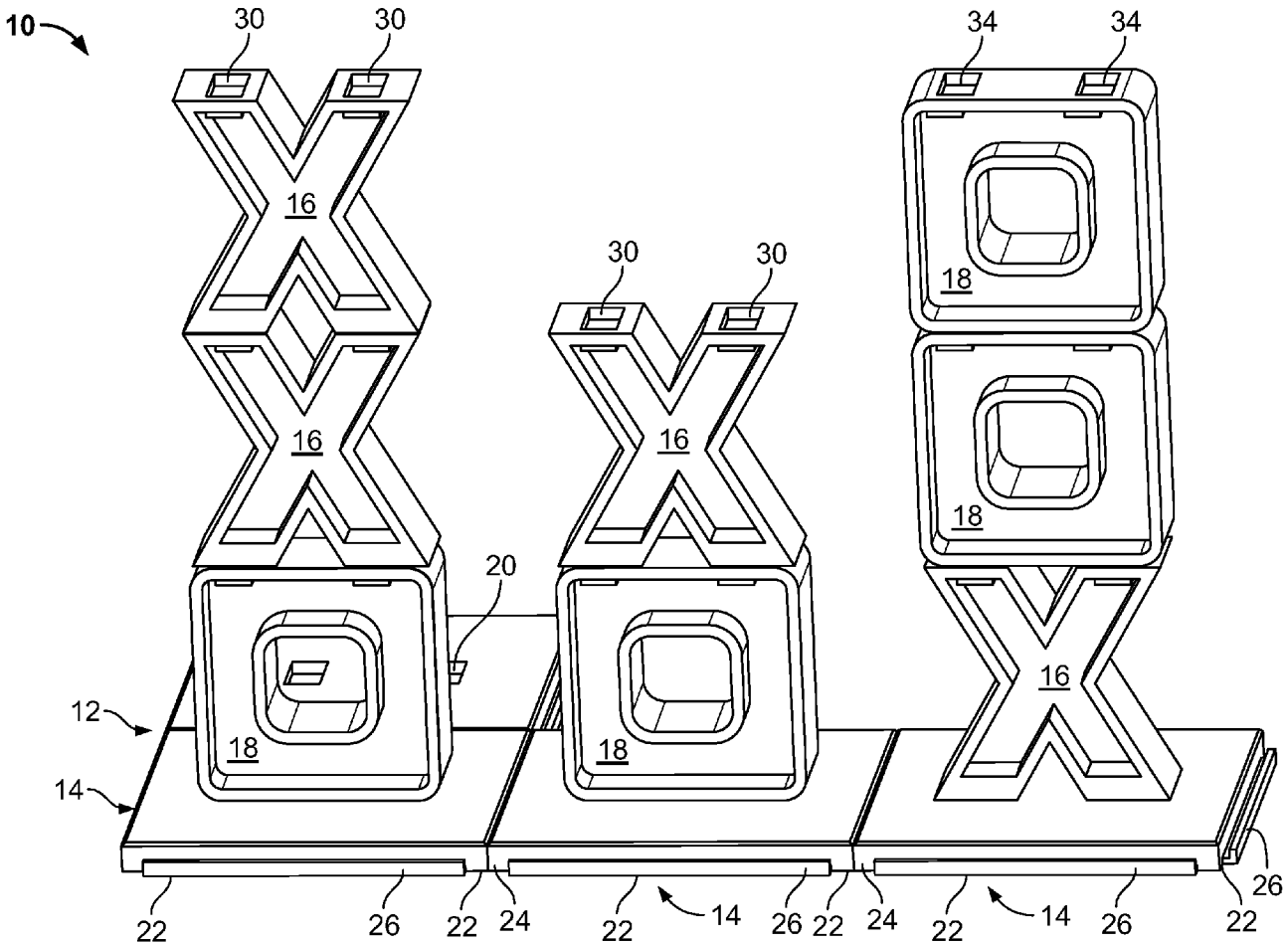
FIG. 2 is a front-elevational view of the game shown in FIG. 1, in which the X-shaped and O-shaped pieces are arranged on the game board in a different configuration.

FIGS. 1 and 2 illustrate a three dimensional tic-tac-toe game 10 (hereinafter "the game 10") constructed in accordance with one embodiment of the present invention. The game 10 includes a game board 12 comprising a plurality of interconnected modules 14. Each of the modules 14 may be square in shape, but it can consist of other shapes and sizes, e.g., rectangular, hexagonal, triangular, etc. As will be described hereinbelow, a plurality of X-shaped pieces 16 and a plurality of O-shaped pieces 18 are releasably installed: i) on the game board 12 in the two dimensional plane of the game board 12, and ii) on top of each other in the third dimension which is normal to the two dimensional plane of the game board 12. The modules 14, the X-shaped pieces 16, and the O-shaped pieces 18 may be fabricated from plastic, foam, metal, wood, or other suitable materials.

Figure 3:
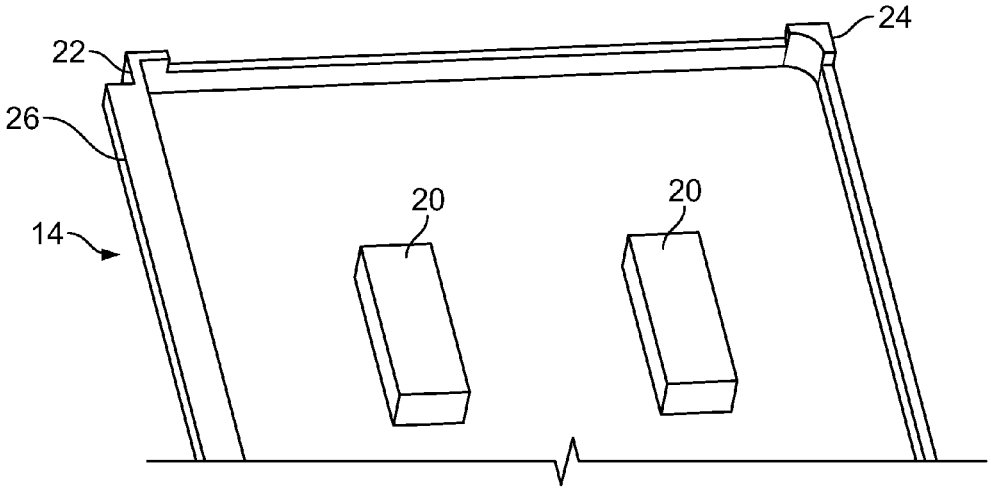
FIG. 3 is a partial bottom-perspective view of a modular section of the game board shown in FIGS. 1 and 2.
Figure 4:
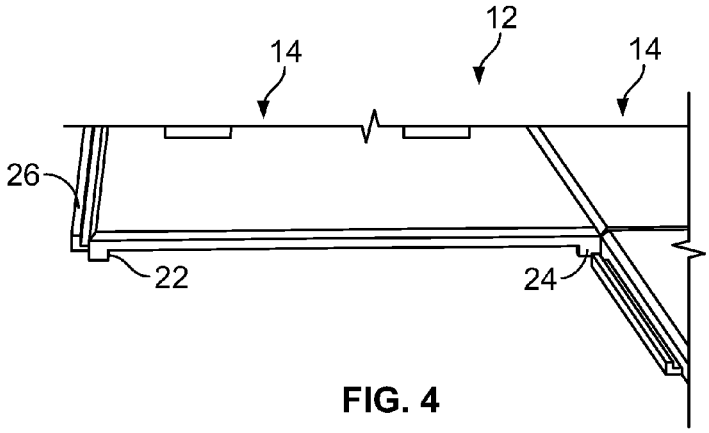
FIG. 4 is a top perspective view of a portion of the game board shown in FIGS. 1 and 2.
Figure 5:
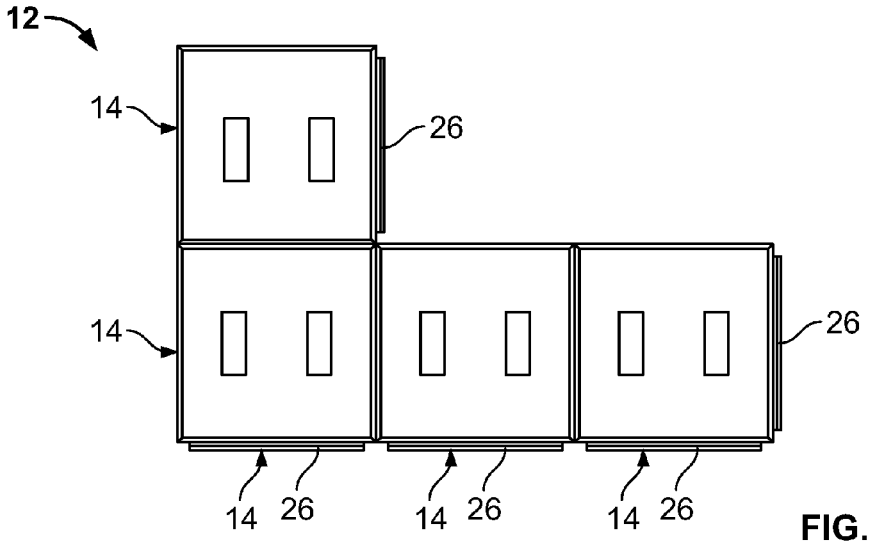
FIG. 5 is top plan view of a plurality of modules of the game board shown in FIGS. 1 and 2.

FIGS. 3 through 5 depict the modules 14 of the game board 12 shown in FIGS. 1 and 2. The exterior of two recesses 20 formed within a top surface of one of the modules 14 are shown along with an elongated stand-off 22 and a corner foot 24. Two stand-offs 22 are positioned proximate the side edges of each of two consecutive sides of the modules 14 (only one stand-off 22 is shown in FIG. 3). An elongated tab 26 is formed in each of the stand-offs 22 (only one of the tabs 26 is shown in FIG. 3). The tabs 26 protrude outwardly from the stand-offs 22 in a plane that is oriented parallel to and below the plane of the top of the module 14. The tabs 26 are inserted in the grooves formed between the foot 24 and the stand-off 22 of adjacent modules 14 to stabilize the formation of the game board 12 (for example, see FIGS. 1, 2, 4 and 5). In an embodiment, the top surface of the module 14 may be raised with beveled edges (i.e., to facilitate stacking the modules 14). The modules 14 may be connected to form an infinite variety of game board shapes (such as a 3×3 module-array, 4×4, 5×5, L-shaped etc.).

Figure 6:
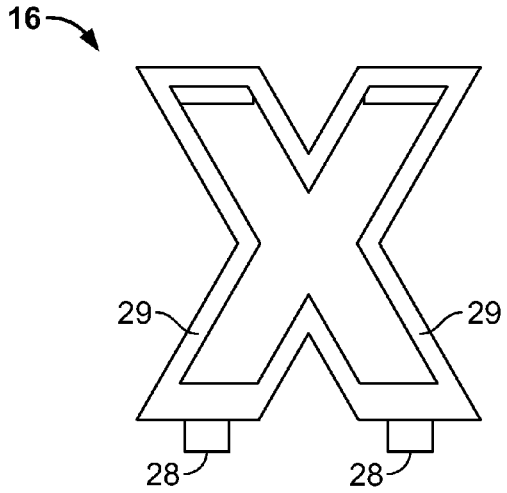
FIG. 6 is a front-elevational view of one of the X-shaped pieces.
Figure 7:
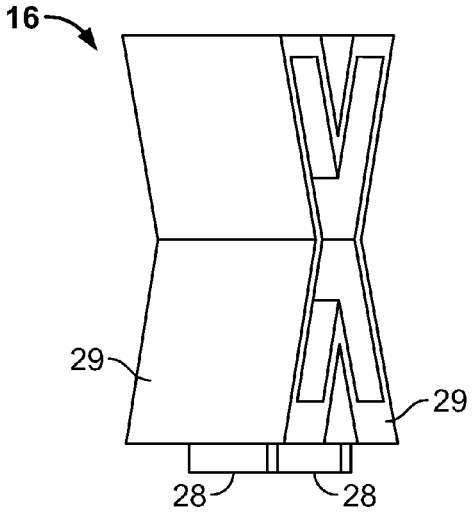
FIG. 7 is a side-perspective view of the X-shaped piece shown in FIG. 6.
Figure 9:
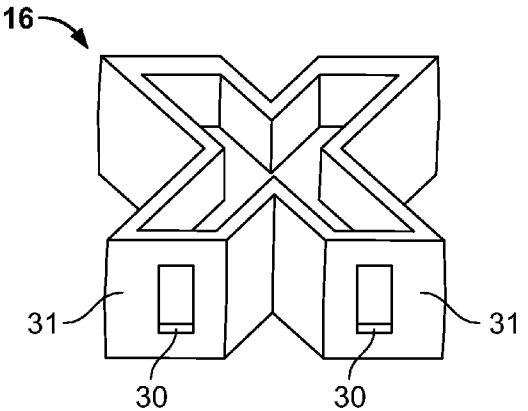
FIG. 9 is a top perspective view of the X-shaped piece shown in FIG. 6.
Figure 8:
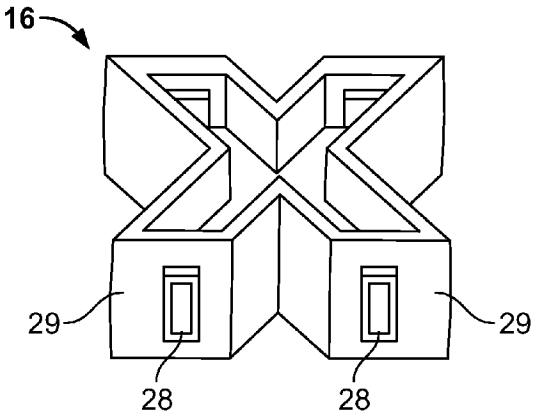
FIG. 8 is a bottom-perspective view of the X-shaped piece shown in FIG. 6.
Figure 11:
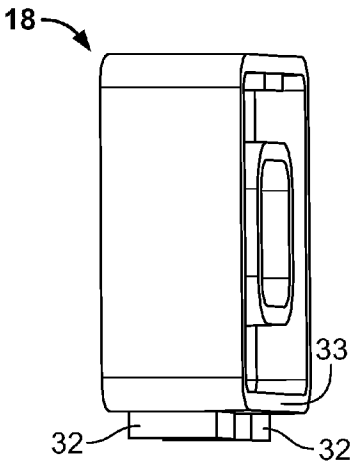
FIG. 11 is a side-perspective view of the O-shaped piece shown in FIG. 10.
Figure 10:
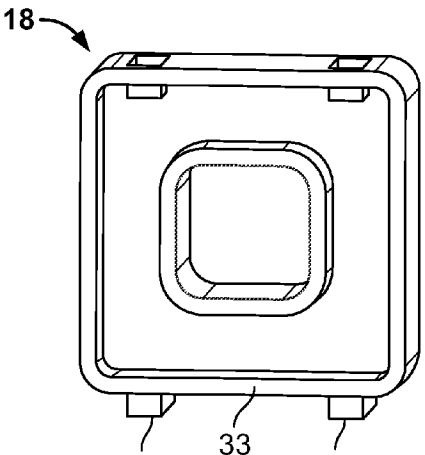
FIG. 10 is a front-elevational view of one of the O-shaped pieces.
Figure 12:
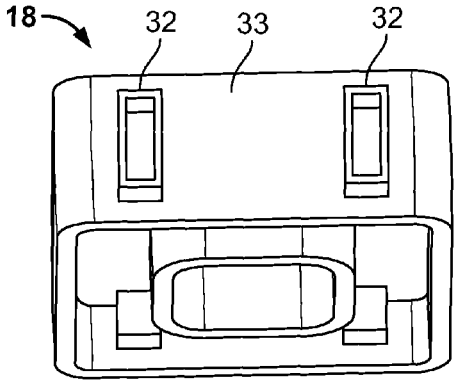
FIG. 12 is a bottom-perspective view of the O-shaped piece shown in FIG. 10.
Figure 13:
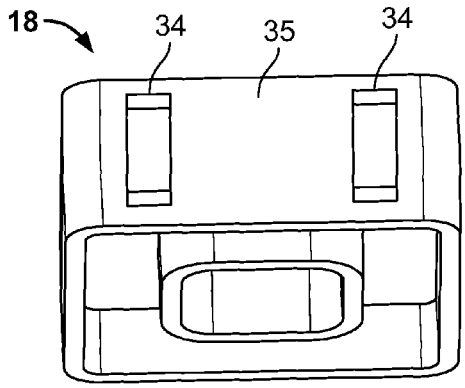
FIG. 13 is a top perspective view of the O-shaped piece shown in FIG. 10.
Figure 14:
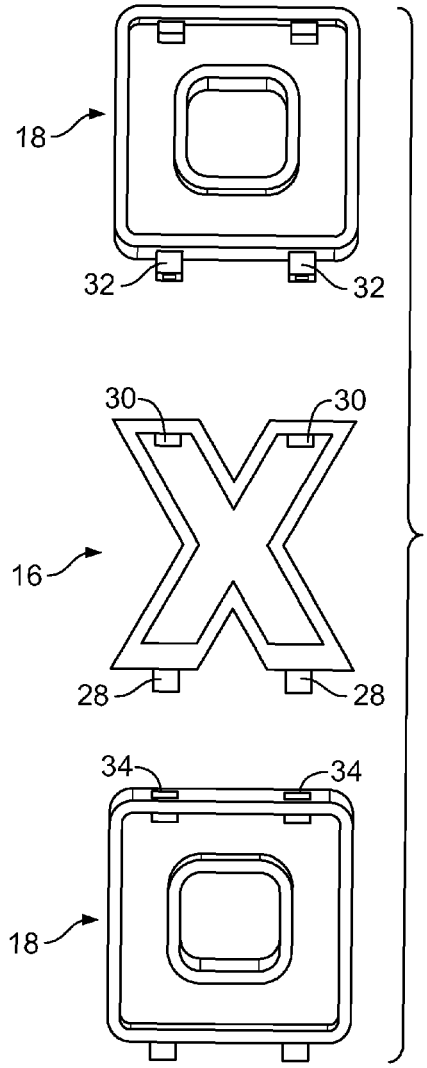
FIG. 14 is a front elevational view of three game pieces, in which one O-shaped piece is positioned adjacent to and above an X-shaped piece, and another O-shaped piece is positioned adjacent to and below the X-shaped piece.

FIGS. 6 through 8 illustrate one of the X-shaped pieces 16 having a pair of protrusions 28, each of which extends outwardly from one of a pair of legs 29, and FIG. 9 illustrates the X-shaped piece 16 having a pair of recesses 30, each of which is formed in a top surface of each of the legs 29. FIGS. 10 through 12 illustrate one of the O-shaped pieces 18 having a pair of protrusions 32 that extend outwardly from a base 33 thereof, and FIG. 13 illustrates a pair of recesses 34 that are formed in a top portion is 35 of the O-shaped piece 18. Referring specifically to FIG. 14, it is shown that the protrusions 32 of the O-shaped piece 18 which is depicted in the upper portion of FIG. 14 are insertable in the recesses 30 of the X-shaped piece 16, and likewise the protrusions 28 of the X-shaped piece 16 are insertable in the recesses 34 of another O-shaped piece 18 which is depicted in the lower portion of FIG. 14. Although not shown in FIG. 14, a first X-shaped piece 16 may be fitted (i.e., stacked or installed in the manner disclosed hereinabove) on a second X-shaped piece 16, and so on, and likewise an O-shaped piece 18 can be fitted on a second O-shaped piece 18, and so on, during play of the tic-tac-toe game 10.

In operation, the protrusions 28, 32 of the X-shaped piece 16 and the O-shaped piece 18, respectively, may be releasably inserted in the recesses 20 of the modules 14 to form constructs during game play (see FIG. 1). Likewise, the protrusions 28, 32 of the X-shaped piece 16 and the O-shaped piece 18, respectively, may be releasably inserted in the recesses 30, 34 of the X-shaped and the O-shaped pieces 16, 18, respectively, to form constructs (see FIG. 1). FIG. 14 illustrates an X-shaped piece 16 and two O-shaped pieces 18 that may form a mated construct in the following manner: i) the protrusions 28 of the X-shaped piece 16 may be inserted in the recesses 34 of the O-shaped piece 18, and ii) the protrusions 32 of the O-shaped piece 18 may be inserted in the recesses 30 of the X-shaped piece 16.

FIGS. 15 through 19 depict a second embodiment of the present invention. Elements illustrated in FIGS. 15 through 19, which correspond, either identically or substantially, to the elements described above with respect to the embodiment of FIGS. 1 through 14 have been designated by corresponding reference numerals increased by one hundred. Unless otherwise stated, the embodiments of FIGS. 15 through 19 are constructed and assembled in the same basic manner as the embodiment of FIGS. 1 through 14.

FIGS. 15 through 19 illustrate a three dimensional tic-tac-toe game 110 (hereinafter "the game 110") constructed in accordance with a second embodiment of the present invention. The game 110 includes a game board 112 comprising a plurality of interconnected modules 114. X-shaped pieces 116 and O-shaped pieces 118 are releasably installed: i) on the game board 112 in the two dimensional plane of the game board 112, and ii) on top of each other in the third dimension which is normal to the two dimensional plane of the game board 112. Each module 114 has a pair of cylinder-shaped recesses 136 that extend within its top surface.

The game 110 includes a plurality of X-shaped pieces 116, each having a pair of cylinder-shaped protrusions 128 that is formed in their bottom surfaces of their legs 129. The pair of protrusions 128 on the bottom of one X-shaped 116 piece is releasably installed on the pair of recesses 136 on one module 114, thereby maintaining the X-shaped piece 116 in an upright position. Each of the X-shaped pieces 116 also has a pair of cylinder-shaped recesses 138 positioned on their top surfaces of their legs 129, for purposes that are described hereinbelow.

The game 110 includes a plurality of O-shaped pieces 118 each having a pair of cylinder-shaped protrusions 132 that are formed within the bottom surface of its base 133. The pair of protrusions on the bottom of one O-shaped piece 118 is releasably installed on the pair of recesses 136 on one module 114, thereby maintaining the O-shaped piece 118 in an upright position. Each of the O-shaped pieces 118 includes round shaped recesses 140 positioned on its top portion 135. The protrusions 128 on the bottom of the X-shaped pieces 116 and the protrusions 132 on the bottom of the O-shaped pieces 118, and the recesses 138, 140 of the X-shaped pieces 116 and the O-shaped pieces 118, respectively, are sized and shaped to facilitate the interconnection of the X-shaped pieces 116 with the O-shaped pieces 118 (for example, see FIGS. 15-19). Likewise, an X-shaped piece 116 may be fitted (i.e., stacked or installed in the manner disclosed hereinabove) on another X-shaped piece 116, and an O-shaped piece 118 may be fitted on another O-shaped piece 118 during play of the tic-tac-toe game 110. In an embodiment, a ridge is be formed on the outer surface of each of the cylinder-shaped protrusions 128, 132, and a correspondingly sized and shaped groove is formed on the inner surface of each of the cylinder-shaped recesses 138, 140. Alternately, in an embodiment, no ridges are formed on the outer surfaces of the cylinder-shaped protrusions 128, 132, and no grooves are formed on the inner surfaces of the cylinder-shaped recesses 138, 140.

Figure 15:
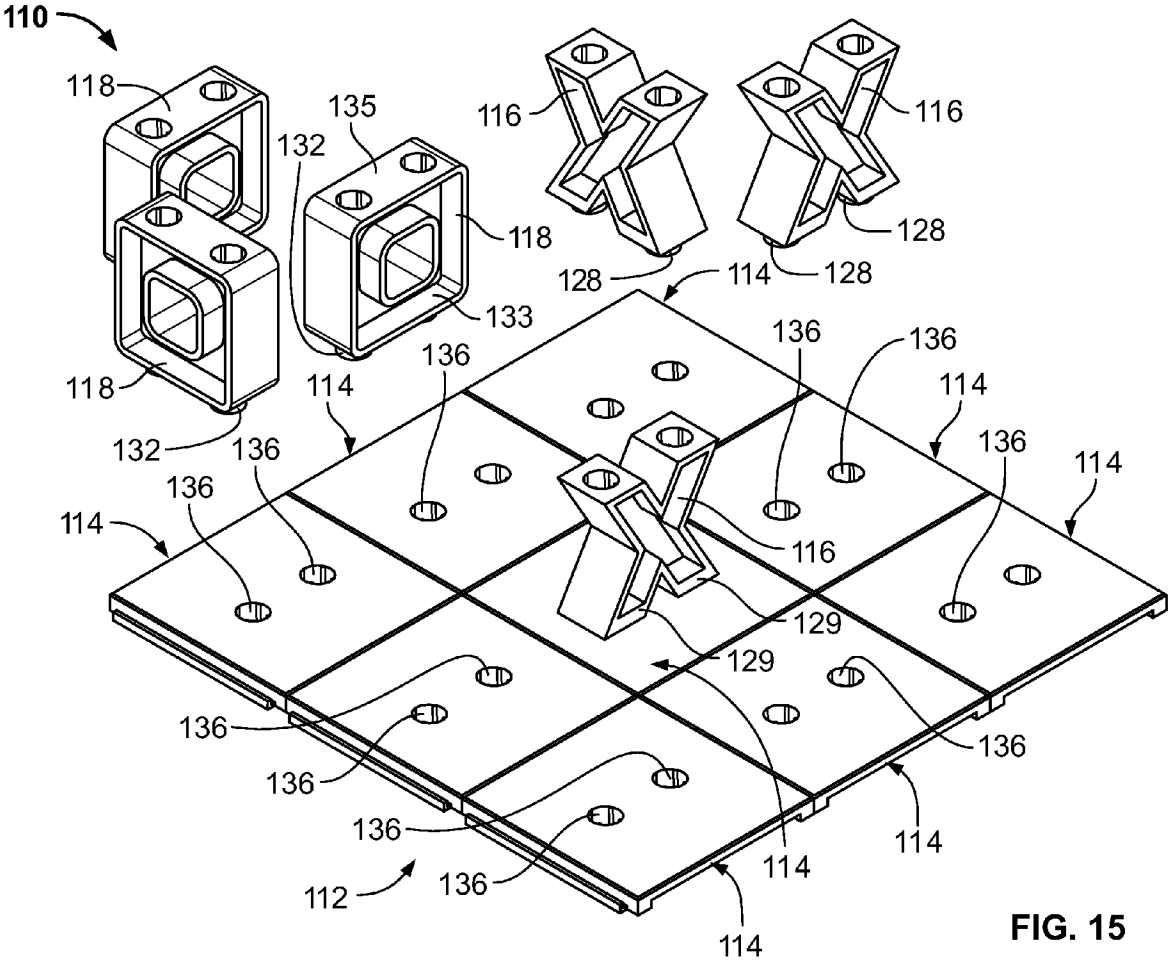
FIG. 15 is a top perspective view of a three-dimensional tic-tac-toe game constructed in accordance with another embodiment of the present invention, taken from the front-left side of a game board comprised of a plurality of interconnected modules on which an X-shaped piece is shown installed on the central module.
Figure 16:
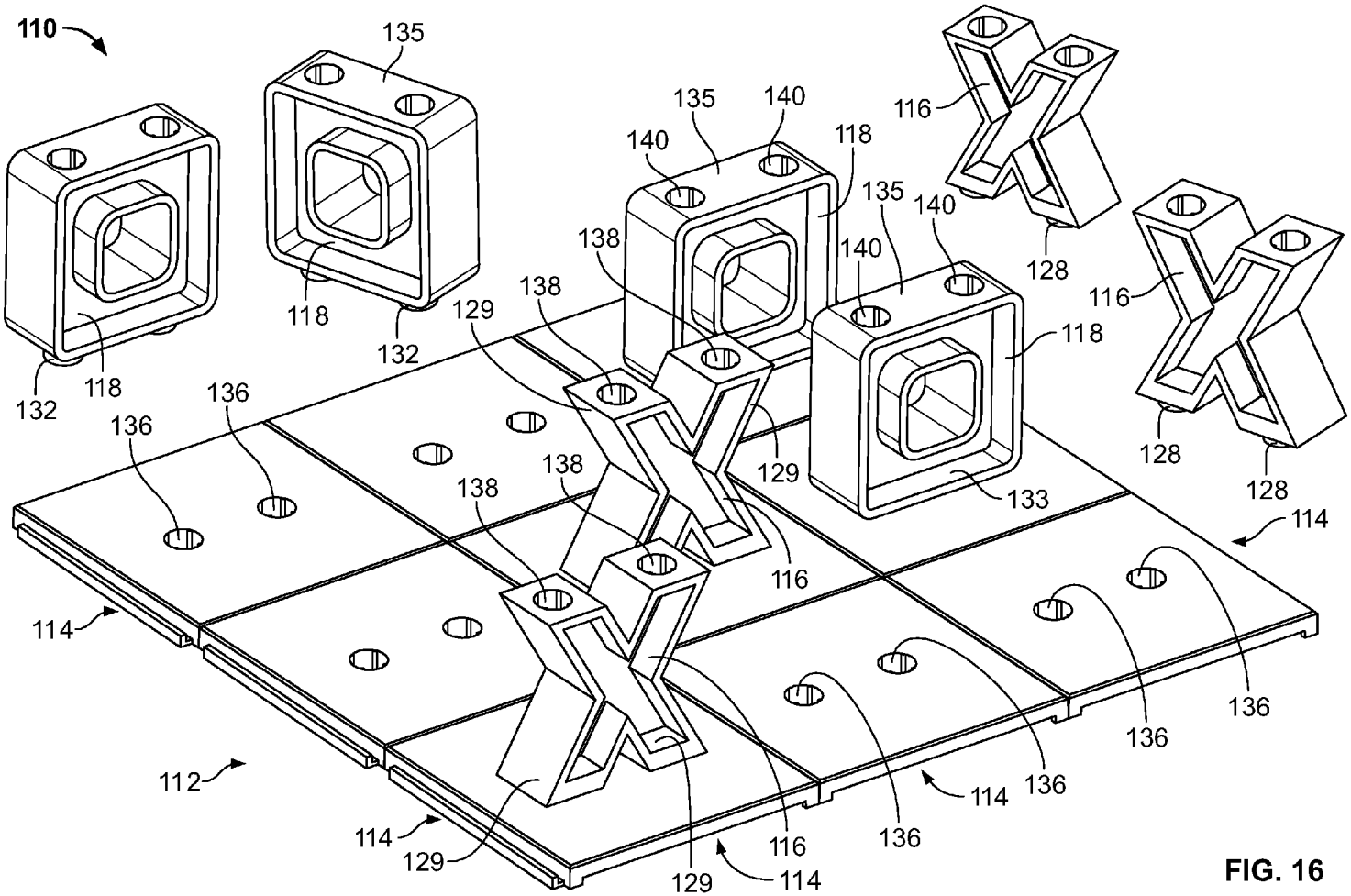
FIG. 16 is a top perspective view, taken from the front-left side of the game board shown in FIG. 15, on which two X-shaped pieces and two O-shaped pieces are installed on the game board.
Figure 17:
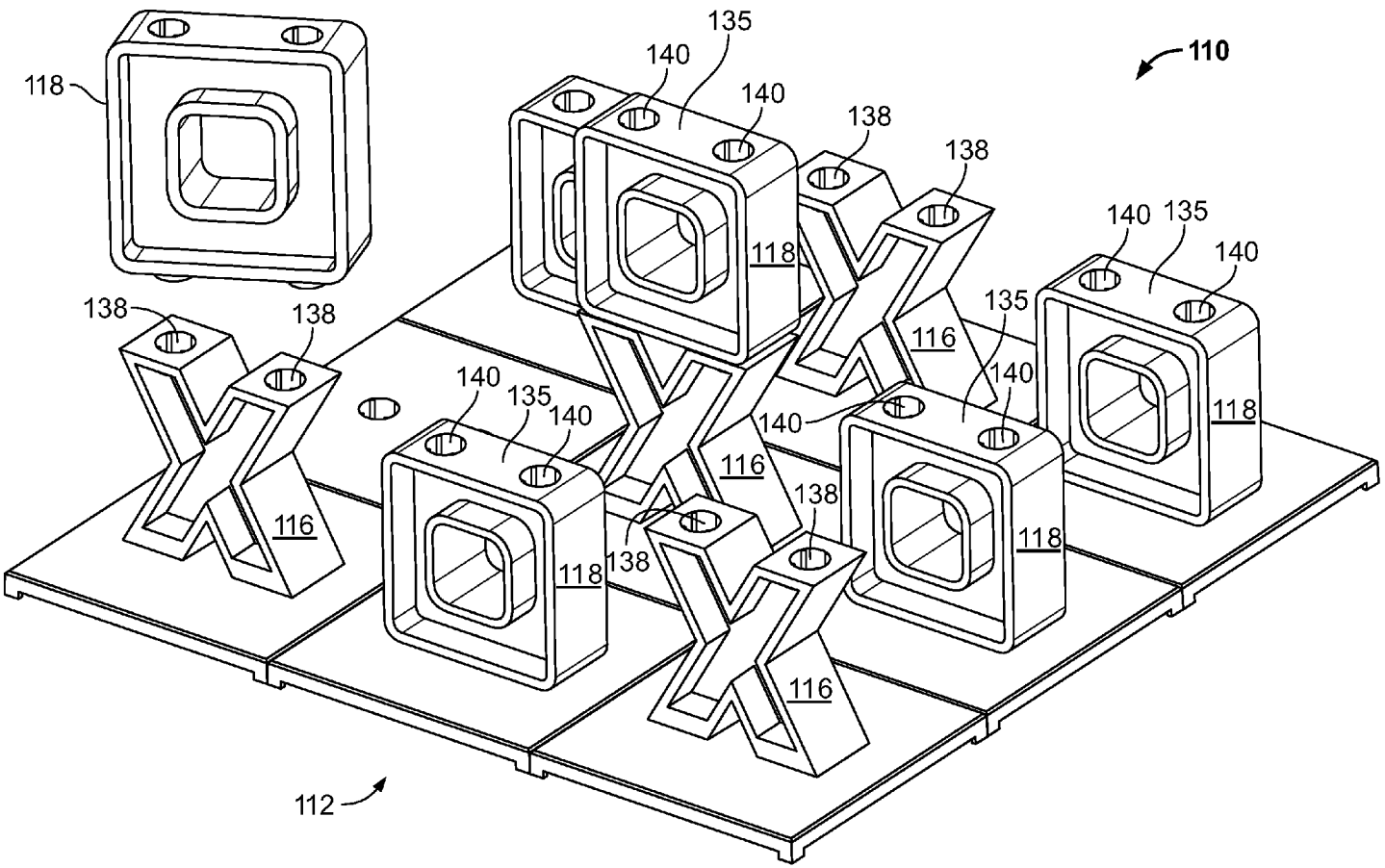
FIG. 17 is a top perspective view, taken from the right-front side of the game board shown in FIG. 15, on which four X-shaped pieces and four O-shaped pieces are installed on the game board, and a fifth O-shaped piece is installed on a second level on top of one of the X-pieces.
Figure 18:
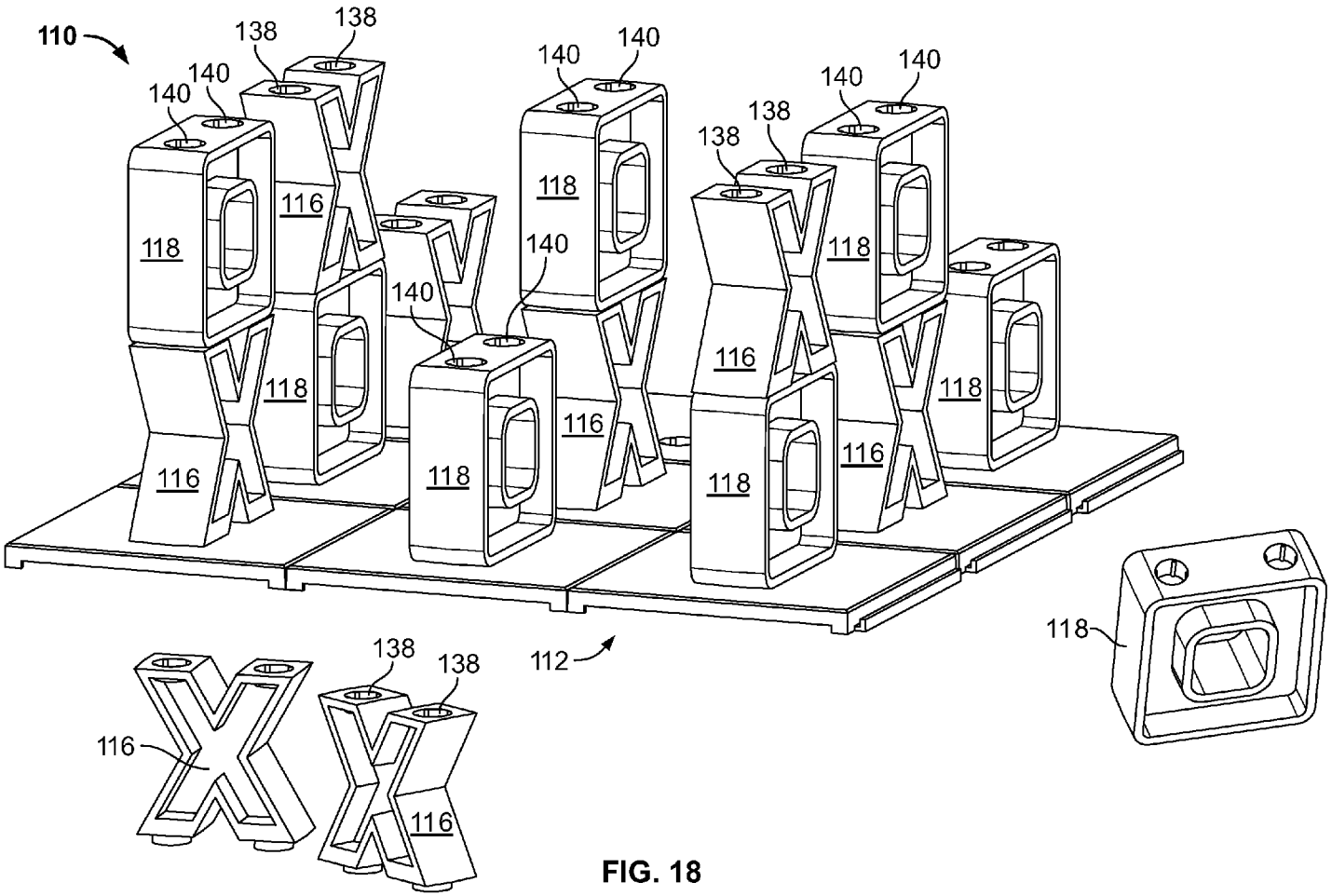
FIG. 18 is a top perspective view, taken form the left rear side of the game board shown in FIG. 15, on which four X-shaped pieces and four O-shaped pieces are installed on the game board, and two O-shaped pieces are installed in a second level on top of two X-shaped pieces, and two X-shaped pieces are installed in a second level on top of two O-shaped pieces.
Figure 19:
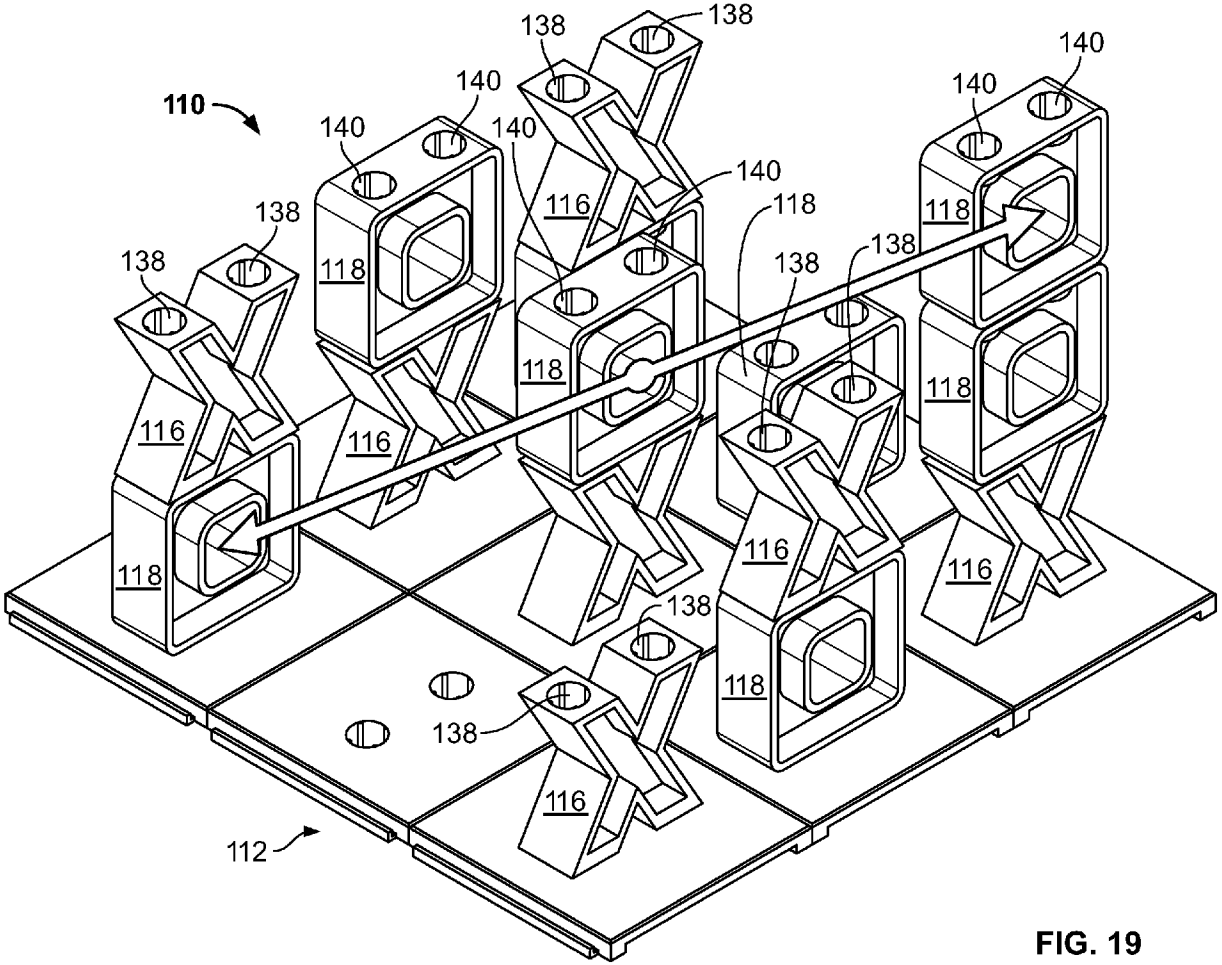
FIG. 19 is a top perspective view, taken from the left front side of the game board shown in FIG. 15, on which four X-shaped pieces and four O-shaped pieces are installed on the game board, and two O-shaped pieces are installed on a second level on top of two X-shaped pieces, and two X-shaped pieces are installed on a second level on top of two O-shaped pieces, and an O-shaped piece is installed on a third level on top of an O-shaped piece, wherein three O-shaped pieces are configured in a winning row in three dimensions above the game board.

In use, referring to FIG. 15, a game is begun with, for instance the placement of an X-shaped piece 116 on the central module 114 of the game board 112. As the game progresses, with reference to FIG. 16, another X-shaped piece 116 and two O-shaped pieces 118 may be installed on the game board 112, in the manner described hereinabove. As the game further progresses, with reference to FIG. 17, a fifth O-shaped piece 118 may be installed on a second level on top of one of the X-pieces 116. As the game further progresses, with reference to FIG. 18, two O-shaped pieces 118 may be installed on a second level on top of two X-shaped pieces 116, and two X-shaped pieces 116 may be installed on a second level on top of two O-shaped pieces 118. Finally, with reference to FIG. 19, an O-shaped piece 118 may be installed on a third level on top of an O-shaped piece 118, wherein three consecutive O-shaped pieces 118 establish a winning row, as indicated by an arrow drawn proximate the three aligned O-shaped pieces 118. Of course, the game 10 can be played with a numerous amount of various sequences.

In an embodiment, FIGS. 20 through 24 depict a third embodiment of the present invention. Elements illustrated in FIGS. 20 through 24, which correspond, either identically or substantially, to the elements described above with respect to the embodiment of FIGS. 1 through 14 have been designated by corresponding reference numerals increased by two hundred. Unless otherwise stated, the embodiments of FIGS. 20 through 24 are constructed and assembled in the same basic manner as the embodiment of FIGS. 1 through 14.

Figure 20:
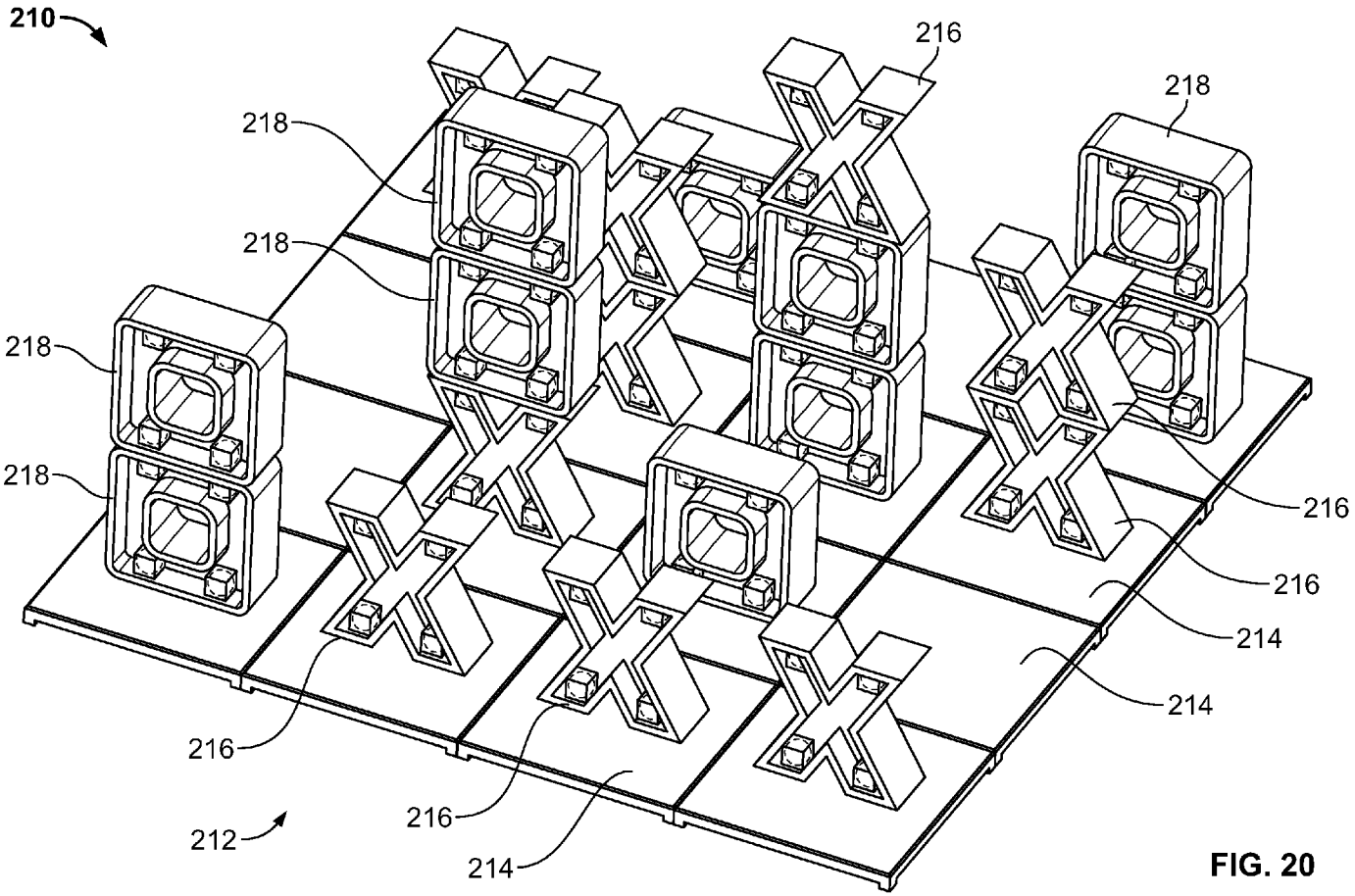
FIG. 20 is a top perspective view of a three dimensional tic-tac-toe game constructed in accordance with another embodiment of the present invention, in which X-shaped and O-shaped pieces are arranged on a game board.
Figure 21:
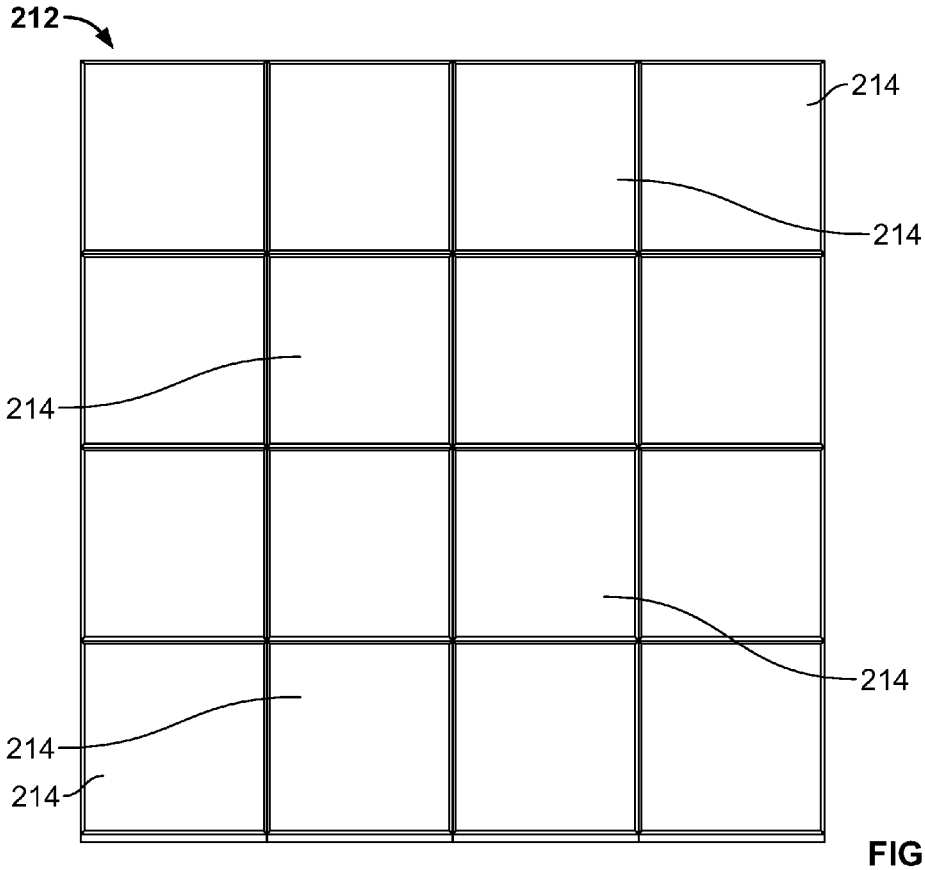
FIG. 21 is a top perspective view of the game board shown in FIG. 20.
Figure 23:
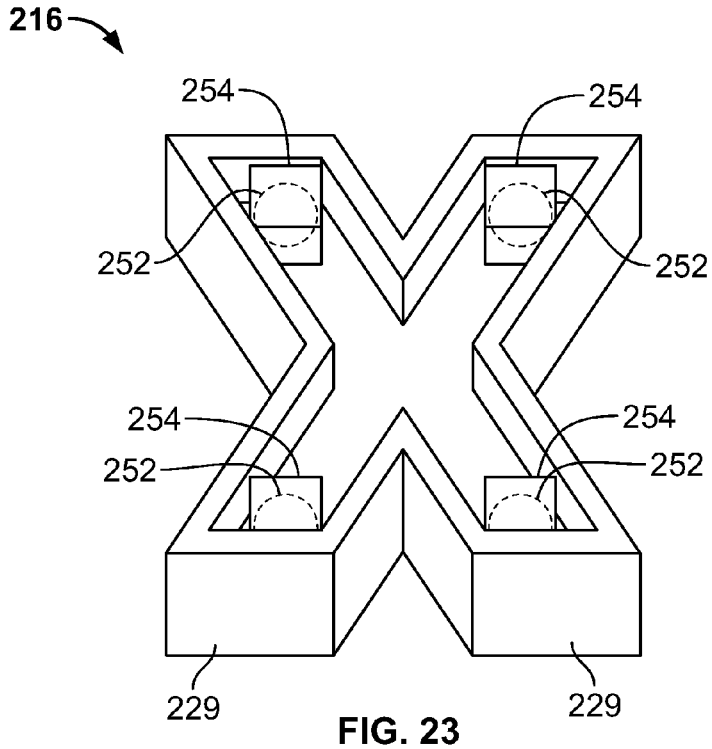
FIG. 23 is a bottom-perspective view of one of the X-shaped pieces shown in FIG. 20.
Figure 24:
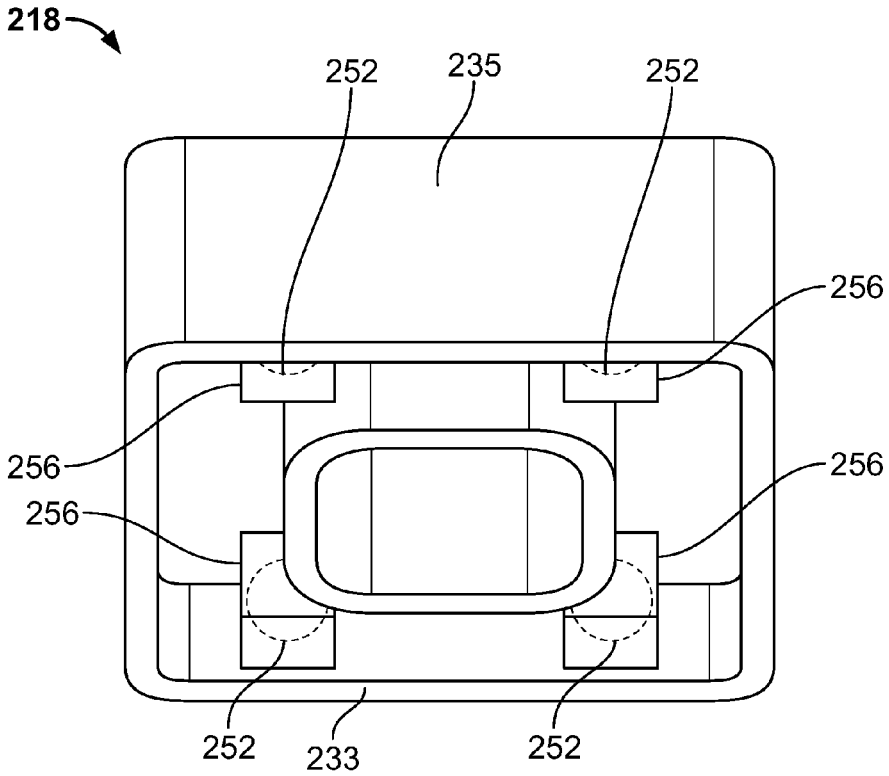
FIG. 24 is a top-perspective view of the one of the O-shaped pieces shown in FIG. 20.

FIG. 20 illustrates a three dimensional tic-tac-toe game 210 (hereinafter "the game 210") constructed in accordance with a third embodiment of the present invention. The game 210 has a game board 212 (see FIG. 21) comprising a plurality of interconnected modules 214 (see FIG. 22). FIGS. 23 and 24 illustrate an X-shaped piece 216 and an O-shaped piece 218, respectively. The X-shaped pieces 216 and the O-shaped pieces 218 are magnetically installed: i) on the game board 212 in the two dimensional plane of the game board 212, and ii) on top of each other in the third dimension which is normal to the two dimensional plane of the game board 212. The modules 214, the X-shaped pieces 216, and the O-shaped pieces 218 each contain one or more magnets which facilitate the play-construction of the game 10.

Figure 22:
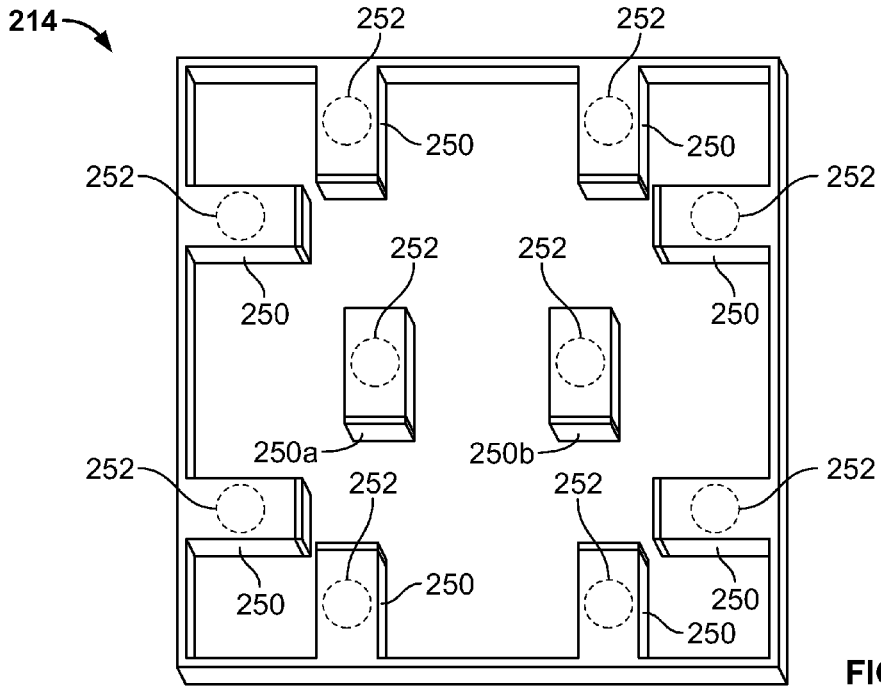
FIG. 22 is a bottom perspective view of a modular section of the game board shown in FIG. 21.

More particularly, referring to FIG. 22, in an embodiment, a plurality of containers 250 are affixed to the bottom of each modules 214. The containers may be rectangle-shaped, as shown in FIG. 22. Alternately, the containers 250 may be configured in any suitable shape such as cubical or spherical. A spherical-shaped magnet 252, shown in phantom in FIG. 22, is positioned in each container 250. The diameter of the magnet 252 is sized so that it is slightly smaller than the smallest interior dimension of the container 250. This permits the magnet 252 to freely to rotate/move within the container 250, for purposes that are described hereinafter.

Two containers 250*a*, 250*b* with magnets 252 positioned therein, are centrally arranged on the underside of the module 214, to attract two adjacent correspondingly positioned magnets 252 that are contained in either an X-shaped piece 216 or an O-shaped piece 218, as will be described hereinbelow. Two containers 250, with magnets 252 positioned therein, are positioned on the underside of the module 214 and arranged along each side of the module 214, to attract two adjacent correspondingly positioned magnets 252 of another module 214, so as to magnetically interconnect modules 214 to form the game board 212. The number and positioning of the containers 250 may vary. For instance, only one container 250, with a magnet 252 contained therein, may be centrally located along each side of the module 214. In an embodiment, the module 214 contains two spaced-apart centrally-located containers 250*a* and 250*b*. In another embodiment, the module 214 may include less or more than the two containers 250*a*, 250*b*.

Referring to FIG. 23, in an embodiment, a cubical-shaped containers 254 is positioned within each of the ends of the legs 229 of the X-shaped pieces 216. Alternately, the containers 254 may be configured in any suitable shape such as spherical. A spherical-shaped magnet 252, shown in phantom in FIG. 23, is positioned in each of the containers 254. The magnet 252 is sized such that its diameter is smaller than any of the interior dimensions of the container 254. This permits the magnet 252 to freely to rotate within the container 254, for purposes that are described hereinafter.

Referring to FIG. 24, in an embodiment, a plurality of containers 256 are positioned within each of the O-shaped pieces 218, such as, for example, two of the containers 256 within the base 233, and two within the top portion 235. Alternately, the containers 256 may configured in any suitable shape such as spherically. A spherical-shaped magnet 252, shown in phantom in FIG. 24, is positioned in each of the containers 256. The magnet 252 is sized such that its diameter is smaller than any of the interior dimensions of the container 256. This permits the magnet 252 to freely rotate within the container 256, for purposes that are described hereinafter. In another embodiment, the magnets 252 are positioned within all sides of the O-shaped piece 218. In another embodiment, the magnets 252 are equally positioned relative to one another within the O-shaped piece 218.

In use, the placement of an X-shaped piece 216 or an O-shaped piece 218 on a module 214 results in the magnetic attraction of the two magnets 252 of the module 214 attracting the opposite poles of the two adjacent magnets 252 of the X-shaped piece 216 or an O-shaped piece 218, thereby fastening the X-shaped piece 216 or the O-shaped piece 218 to the modules 214. Likewise, for example, the placement of an X-shaped piece 216 on top of an O-shaped piece 218, results in the magnetic attraction of two magnets 252 of the X-shaped piece 216 attracting the opposite poles of the two adjacent magnets 252 of the O-shaped piece 218, thereby fastening the X-shaped piece 216 on top of an O-shaped piece 218.

As discussed above, the spherically shaped magnets 252 are free to rotate within the containers 250, 254, and 256. This freedom of motion enables a magnetic-dynamics that permits the pole of any magnet 252 positioned within any one of the containers 250, 254, or 256 to attract the opposite pole of a magnet 252 located within any one adjacent container 250, 254, or 256. This magnetic-dynamics contribute to a desirable play feature whereby all of the elements of the game 210 (i.e., the X-shaped pieces 216, the O-shaped pieces 218, and the modules 214) are always attracted to each other, and never repelled from each other, regardless of what elements are positioned adjacent to each other. It is also understood, that in an embodiment, the shape of the magnets 252 may alternately be bar-shaped, rod-shaped, or have any other suitable shape. In addition, the magnets 252 may be embedded in the elements of the game 210 (i.e., the X-shaped pieces 216, the O-shaped pieces 218, and the modules 214), as opposed to being freely contained in the containers 250, 254, and 256.

It should be noted that the present invention can have numerous modifications and variations. For instance, while the X-shaped pieces 16, 116, 216 and the O-shaped pieces 18, 118, 218 have web-shaped perimeters and interior structures, these pieces may be formed with alternate perimeters and interior formations such as hollow fabrications (i.e., without web-shaped perimeters and interior structures). Also, the protrusions 28, 32 of the X-shaped pieces 16 and the O-shaped pieces 18, respectively, and the recesses 20, 30, and 34 of the game board 12, the X-shaped pieces 16, and the O-shaped pieces 18, respectively, may be replaced with Velcro® hook and loop fasteners, LEGO® like studs and receptacles, or other suitable materials for releasably interconnecting the elements of the game 10.

In the case of Velcro® hook and loop fasteners, the hooks and loops may be applied in a similar fashion as the positive-pole and negative-pole magnets. Therefore, the hooks attach to corresponding loops.

In the case of LEGO® like studs and receptacles: i) the studs may be applied in a similar fashion as the protrusions 28, 32 of the X-shaped pieces 16 and the O-shaped pieces 18, respectively, and 2) the receptacles may be applied in a similar fashion as the recesses 20, 30, and 34 of the game board 12, the X-shaped pieces 16, and the O-shaped pieces 18, respectively. Therefore, the studs attach to corresponding receptacles.

In an embodiment, at any point during play of the game, because of the spatial separation between the rows of the constructs, and between each level in the third-dimension, the constructs of the game pieces 16, 18 are easily seen by the players. More particularly, because of the spatial separation between the rows of the constructs, and the 3-D levels, visualization blind spots are reduced which: i) facilitates faster and more exciting game play, and ii) enhances the overall enjoyment in playing the game. Furthermore, the game 10 may be assembled and played on a Lazy Susan type table which will allow players to conveniently rotate the game in order to better visualize the progress of the game. Also, the modules 14, 114, 214 can be connected to form an infinite number of arrays (e.g., 3×3, 4×4, 5×5, L-shape etc.), thereby producing an infinite number of game board configurations. Further, the X-shaped pieces 16 and the O-shaped pieces 18 are stackable to form firm, secure, stable and very visible constructs during play of the game.

In other embodiments, the X-shaped pieces 16, 116, 216, the O-shaped pieces 18, 118, 218 and the modules 14 114, 214 of the game board 12, 112, 212 may have glow-in-the-dark features, or may include illuminated elements, such as LED lights.

Figure 25:
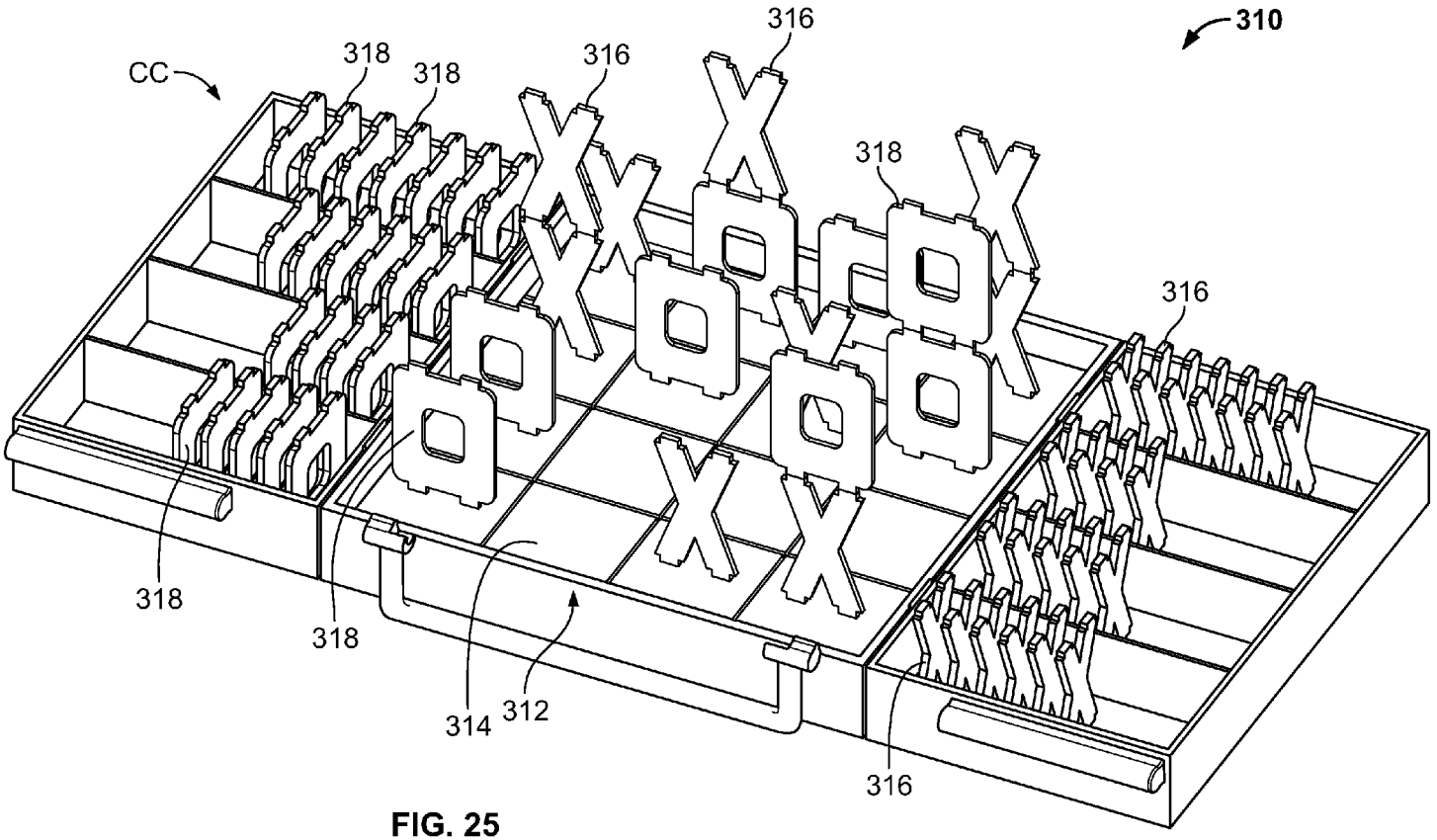
FIG. 25 is a top perspective view of another embodiment of a three-dimensional tic-tac-toe game.

In an embodiment, a portable game 310 may be contained in a portable carrying case CC. FIG. 25 illustrates the carrying case CC in the open position, showing a game board 312 having magnet modules 314. X-shaped pieces 316 and O-shaped-pieces 318 are shown in storage and in play on the game board 312. It is understood that the is size and weight of the X-shaped pieces 316, O-shaped-pieces 318, and the modules 314 may be less than the X-shaped pieces 16, 116, 216, the O-shaped pieces 18, 118, 218 and the modules 14 114, 214, respectively, in order to facilitate the portability of the carrying case CC.

It will be understood that the embodiment described herein is merely exemplary and that a person skilled in the art may make many variations and modifications without departing from the spirit and scope of the invention. For instance, all such variations and modifications are intended to be included within the scope of the invention as defined in the appended claims.

What is claimed is:

1. A tic-tac-toe game, comprising:

a game board having a plurality of modules adapted to be interconnected to one another, each of the plurality of modules including a pair of recesses;

a plurality of X-shaped game pieces, each of which includes a first end, a second end opposite the first end, a pair of legs, each of which extends from the first end to the second end, a pair of protrusions, one of which extends from the first end of one of the pair of legs, and the other of which extends from the first end of the other of the pair of legs, and a pair of recesses, one of which is formed within the second end of one of the pair of legs, and the other of which is formed within the second end of the other of the pair of legs; and a plurality of O-shaped game pieces, each of which includes a first end, a second end opposite the first end of the O-shaped game piece, a pair of protrusions extending from the first end of the O-shaped game piece, and a pair of recesses formed within the second end of the O-shaped game piece, wherein each of the protrusions of each of the plurality of X-shaped game pieces is sized and shaped to engage a corresponding one of the recesses of one of the plurality of modules of the game board, a corresponding one of the recesses of another of the plurality of X-shaped game pieces, and a corresponding one of the recesses of one of the plurality of O-shaped game pieces, and wherein each of the protrusions of each of the plurality of O-shaped game pieces is sized and shaped to engage a corresponding one of the recesses of one of the plurality of modules of the game board, a corresponding one of the recesses of another of the plurality of O-shaped game pieces, and a corresponding one of the recesses of one of the plurality of X-shaped game pieces.

2. The tic-tac-toe game of claim 1, wherein each of the plurality of modules of the game board includes at least one tab and at least one groove, wherein the at least one tab of one of the plurality of modules is sized and shaped to engage the at least one groove of another of the plurality of modules.

3. The tic-tac-toe game of claim 2, wherein the at least one tab includes a pair of tabs and the at least one groove includes a pair of grooves.

4. The tic-tac-toe game of claim 3, wherein the plurality of modules form a 3×3 array of the modules.

5. The tic-tac-toe game of claim 3, wherein the plurality of modules form a 4×4 array of the modules.

6. The tic-tac-toe game of claim 3, wherein the plurality of modules form a 5×5 array of the modules.

7. The tic-tac-toe game of claim 1, wherein the each of the plurality of first game pieces is adapted to be stacked on top of another of the first game pieces and one of the plurality of second game pieces, and wherein each of the plurality of second game pieces is adapted to be stacked on top of another of the second game pieces and one of the plurality of first game pieces.

8. The tic-tac-toe game of claim 1, wherein each of the plurality of first and second game pieces includes an illumination source.

9. A tic-tac-toe game, comprising:

a game board having a plurality of modules adapted to be interconnected to one another, each of the plurality of modules including a pair of magnets;

a plurality of X-shaped game pieces, each of which includes a first end, a second end opposite the first end, a pair of legs, each of which extends from the first end to the second end, a pair of first magnets, one of which is located at the first end of one of the pair of legs, and the other of which is located at the first end of the other of the pair of legs, and a pair of second magnets, one of which is located at the second end of one of the pair of legs, and the other of which is located at the second end of the other of the pair of legs; and a plurality of O-shaped game pieces, each of which includes a first end, a second end opposite the first end of the O-shaped game piece, a pair of first magnets located at the first end of the O-shaped game piece, and a pair of second magnets located at the second end of the O-shaped game piece, wherein each of the first magnets of each of the plurality of X-shaped game pieces is adapted to engage a corresponding one of the magnets of one of the plurality of modules of the game board, a corresponding one the second magnets of another of the plurality of X-shaped game pieces, and a corresponding one of the second magnets of one of the plurality of O-shaped game pieces, and wherein each of the first magnets of each of the plurality of O-shaped game pieces is adapted to engage a corresponding one of the magnets of one of the plurality of modules of the game board, a corresponding one the second magnets of another of the plurality of O-shaped game pieces, and a corresponding one of the second magnets of one of the plurality of X-shaped game pieces.

10. The tic-tac-toe game of claim 9, wherein each of the plurality of modules of the game board includes a plurality of magnets located around a periphery thereof, wherein the plurality of magnets of one of the plurality of modules is adapted to engage the plurality of magnets of another of the plurality of modules.

11. The tic-tac-toe game of claim 10, wherein the plurality of modules form a 3×3 array of the modules.

12. The tic-tac-toe game of claim 11, wherein the plurality of modules form a 4×4 array of the modules.

13. The tic-tac-toe game of claim 11, wherein the plurality of modules form a 5×5 array of the modules.

14. The tic-tac-toe game of claim 9, wherein the each of the plurality of first game pieces is adapted to be stacked on top of another of the first game pieces and one of the plurality of second game pieces, and wherein each of the plurality of second game pieces is adapted to be stacked on top of another of the second game pieces and one of the plurality of first game pieces.

15. The tic-tac-toe game of claim 9, wherein each of the plurality of first and second game pieces includes an illumination source.

* * * * *